US009190762B2

(12) United States Patent
Xu et al.

(10) Patent No.: US 9,190,762 B2
(45) Date of Patent: Nov. 17, 2015

(54) INTEGRATED COMPRESSION CONNECTOR

(71) Applicant: Changzhou Amphenol Fuyang Communication Equip. Co., Ltd., Changzhou (CN)

(72) Inventors: Yiming Xu, Changzhou (CN); Tingxing Sheng, Changzhou (CN)

(73) Assignee: Changzhou Amphenol Fuyang Communication Equipment Co., Ltd. (CN)

( * ) Notice: Subject to any disclaimer, the term of this patent is extended or adjusted under 35 U.S.C. 154(b) by 126 days.

(21) Appl. No.: 13/751,520

(22) Filed: Jan. 28, 2013

(65) Prior Publication Data

US 2014/0057490 A1 Feb. 27, 2014

(30) Foreign Application Priority Data

Aug. 27, 2012 (CN) ..... 2012 2 0427107 U

(51) Int. Cl.

| | |
|---|---|
| ***H01R 9/05*** | (2006.01) |
| ***H01R 13/502*** | (2006.01) |
| ***H01R 13/52*** | (2006.01) |
| ***H01R 13/622*** | (2006.01) |
| ***H01R 24/56*** | (2011.01) |

(52) U.S. Cl.

CPC ..... *H01R 13/502* (2013.01); *H01R 13/5202* (2013.01); *H01R 13/5205* (2013.01); *H01R 13/5219* (2013.01); *H01R 13/622* (2013.01); *H01R 24/564* (2013.01)

(58) Field of Classification Search

CPC ..... H01R 2103/00; H01R 9/0521; H01R 13/5208

USPC ..... 439/578, 583, 584, 587

See application file for complete search history.

(56) References Cited

U.S. PATENT DOCUMENTS

| | | | | | |
|---|---|---|---|---|---|
| 4,046,451 | A | * | 9/1977 | Juds et al. | 439/583 |
| 5,154,636 | A | * | 10/1992 | Vaccaro et al. | 439/583 |
| 5,284,449 | A | * | 2/1994 | Vaccaro | 439/583 |
| 5,354,217 | A | * | 10/1994 | Gabel et al. | 439/583 |
| 5,518,420 | A | * | 5/1996 | Pitschi | 439/578 |
| 5,561,900 | A | * | 10/1996 | Hosler, Sr. | 29/828 |
| 5,795,188 | A | * | 8/1998 | Harwath | 439/583 |
| 5,938,474 | A | * | 8/1999 | Nelson | 439/583 |
| 5,984,723 | A | * | 11/1999 | Wild | 439/583 |
| 6,032,358 | A | * | 3/2000 | Wild | 29/863 |
| 6,558,194 | B2 | | 5/2003 | Montena | |
| 6,676,446 | B2 | | 1/2004 | Montena | |
| 6,808,415 | B1 | | 10/2004 | Montena | |
| 6,848,940 | B2 | | 2/2005 | Montena | |
| 7,070,447 | B1 | | 7/2006 | Montena | |
| 7,077,700 | B2 | * | 7/2006 | Henningsen | 439/583 |
| 7,156,696 | B1 | | 1/2007 | Montena | |
| 7,189,115 | B1 | | 3/2007 | Montena | |
| 7,311,554 | B1 | | 12/2007 | Jackson et al. | |
| 7,329,149 | B2 | | 2/2008 | Montena | |

(Continued)

*Primary Examiner* — Thanh Tam Le

(74) *Attorney, Agent, or Firm* — Blank Rome LLP

(57) ABSTRACT

An integrated compression connector that comprises a housing that has opposing first and second ends. The housing supports a pin and the pin is supported by an insulator disposed in the housing. The pin includes an elastic end for engaging a cable conductor. A threaded sleeve is externally coupled to the housing at the first end thereof. A cable clamp is externally coupled to the housing at the second end thereof. The cable clamp is configured to clamp to a corrugated outer conductor of a cable, wherein the housing engages the cable clamp in an interference fit to form an integrated structure.

8 Claims, 4 Drawing Sheets

(56) References Cited

U.S. PATENT DOCUMENTS

| | | | | |
|---|---|---|---|---|
| 7,357,671 | B2 * | 4/2008 | Wild et al. | 439/583 |
| 7,357,672 | B2 | 4/2008 | Montena | |
| 7,374,455 | B2 | 5/2008 | Purdy et al. | |
| 7,431,614 | B2 | 10/2008 | Eriksen | |
| 7,458,851 | B2 * | 12/2008 | Montena | 439/584 |
| 7,462,069 | B2 * | 12/2008 | Studerus | 439/584 |
| 7,637,774 | B1 * | 12/2009 | Vaccaro | 439/578 |
| 7,908,741 | B2 | 3/2011 | Chawgo | |
| 7,934,954 | B1 * | 5/2011 | Chawgo et al. | 439/578 |
| 7,993,159 | B2 | 8/2011 | Chawgo | |
| 8,007,314 | B2 | 8/2011 | Chawgo et al. | |
| 8,038,472 | B2 * | 10/2011 | Montena et al. | 439/578 |
| 8,123,557 | B2 * | 2/2012 | Montena et al. | 439/584 |
| 8,177,582 | B2 * | 5/2012 | Amidon | 439/578 |
| 8,177,583 | B2 | 5/2012 | Chawgo et al. | |
| 8,366,482 | B2 * | 2/2013 | Burris et al. | 439/584 |
| 2009/0197465 | A1 * | 8/2009 | Montena et al. | 439/584 |
| 2011/0312210 | A1 | 12/2011 | Chawgo et al. | |
| 2012/0190234 | A1 | 7/2012 | Montena et al. | |

* cited by examiner

INTEGRATED COMPRESSION CONNECTOR

RELATED APPLICATION

The present application claims priority under 35 U.S.C. §119 to Chinese Patent Application No. 201220427107.0; filed Aug. 27, 2012 the entire disclosure of which is incorporated by reference herein.

FIELD OF THE INVENTION

The present invention relates to the technical field of a cable connector, and more particularly to a waterproof cable connection system.

BACKGROUND OF THE INVENTION

In mobile communication base station or indoor coverage systems, connectors are indispensable for the transmission of high-frequency signal and power. Such connectors are usually connected to either annular corrugated cable or helically corrugated cable. Because conventional connectors are both under threaded connection and are structurally split, the conventional connectors cannot ensure lasting, good and stable connection of cable conductors. In addition, water seepage during the use of the connector could affect its application effect, and cause damage to equipment.

Therefore, there remains a need for a cable connector that ensures a stable and positive connection of the cable conductors and provides overall environmental protection.

SUMMARY OF THE INVENTION

Accordingly, the present invention provides an integrated compression connector that comprises a housing that has opposing first and second ends. The housing supports a pin and the pin is supported by an insulator disposed in the housing. The pin includes an elastic end for engaging a cable conductor. A threaded sleeve is externally coupled to the housing at the first end thereof. A cable clamp is externally coupled to the housing at the second end thereof. The cable clamp is configured to clamp to a corrugated outer conductor of a cable, wherein the housing engages the cable clamp in an interference fit to form an integrated structure. In one embodiment, the corrugated outer conductor of the cable is helically corrugated.

The present invention also provides an integrated compression connector that comprises a main housing that has opposing first and second ends. The main housing supporting a pin. The pin is supported by an insulator disposed in the main housing. The pin includes an elastic end for engaging a cable conductor. A threaded sleeve is externally coupled to the main housing at the first end thereof. A secondary housing is externally coupled to the main housing at the second end thereof. A cable clamp is received in the secondary housing. The cable clamp is configured to clamp to a corrugated outer conductor of a cable, wherein the main housing engages the secondary housing in an interference fit to form an integrated structure. In one embodiment, the corrugated outer conductor of the cable is an annular corrugated conductor.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Referring to FIGS. 1-11, an integrated compression connector in accordance with exemplary embodiments of the present invention is designed to provide rapid installation on an associated cable and also improves the overall environmental protection for the connector including a reduction in water seepage.

Figure 1:
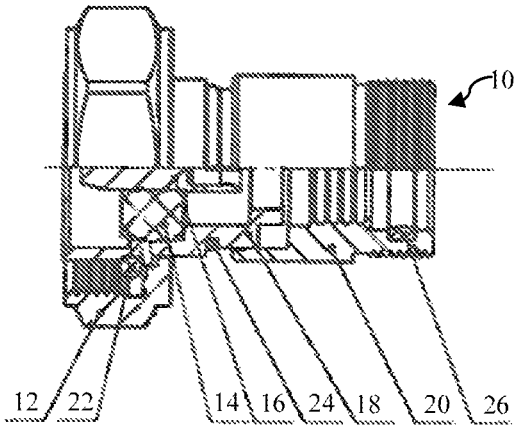
FIG. 1 is a partial cross-sectional view of an integrated compression connector according to an exemplary embodiment of the present invention.
Figure 2:
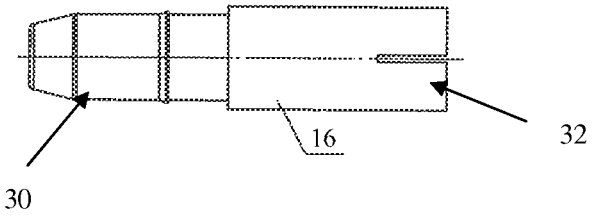
FIG. 2 is a side view of a pin of the connector shown in FIG. 1.
Figure 3:
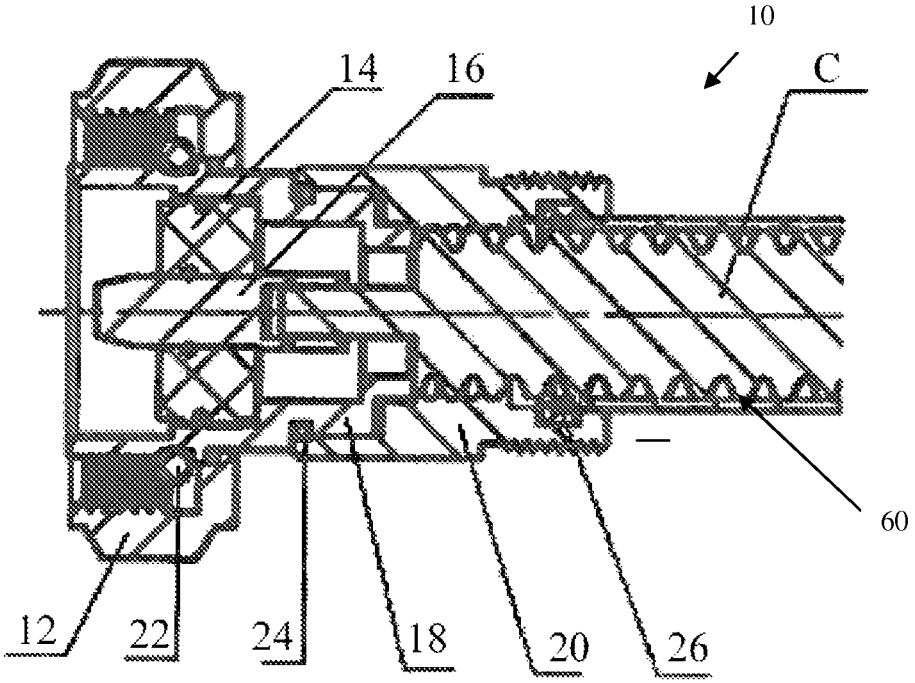
FIG. 3 is a cross-sectional view of the connector illustrated in FIG. 1, showing a cable, such as a superflex cable, terminated to the connector.

FIGS. 1-3 illustrate an exemplary embodiment of the present invention that relates to an integrated compression connector 10. The compression connector 10 is used to terminate a cable C, such as a superflex cable, which may have a helically corrugated outer conductor. The compression connector 10 generally comprises a threaded sleeve 12, an insulator 14, a pin 16, a main housing 18 and a cable clamp 20. The insulator 14 is arranged within the main housing 18 and supports the pin 16. The pin 16 is internally connected with the main housing 18 via the insulator 14. The threaded sleeve 12 is externally coupled to the main housing 18 at one end thereof and the cable clamp 20 is externally coupled to an opposite end of the main housing 18. The pin 16 preferably includes an interface end 30 and an opposite elastic end 32. The interface end 30 is adapted to engage a mating connector. The elastic end part 32 is designed to engage a center conductor of the cable. The elastic end part 32 may be formed by grooving mining, for example.

The main housing 18 preferably engages the cable clamp 20 in an interference fit and is preferably installed coaxially with the pin 16. A first O-shaped ring 22 may be arranged between the threaded sleeve 12 and the housing 18 to provide a seal to prevent entrance of water. A second O-shaped ring 24 may be arranged between the housing 18 and the cable clamp 20 to provide another seal. A flat O-shaped ring 26 may be arranged within the cable clamp 20 for preventing water from flowing into the connector along the cable C. The main housing 18 is preferably made of metal.

To assemble the connector 10 of this embodiment to the cable C (FIG. 3), the cable C, that is properly wire-stripped and prepared as is known in the art, is directly screwed into the connector via an inlet of the cable clamp 20 and is then connected thereto in a pressing manner by use of a tool, so that the clamp 20 clamps to the outer corrugated conductor 60 of the cable C such that the connector 10 cannot be easily disengaged from the cable C. In the process of clamping the connector to the cable C, the housing 18 moves toward the cable clamp 20 and is received in the end of the cable clamp 20 in an interference fit to form an integrated structure, as seen in FIG. 3.

Figure 4:
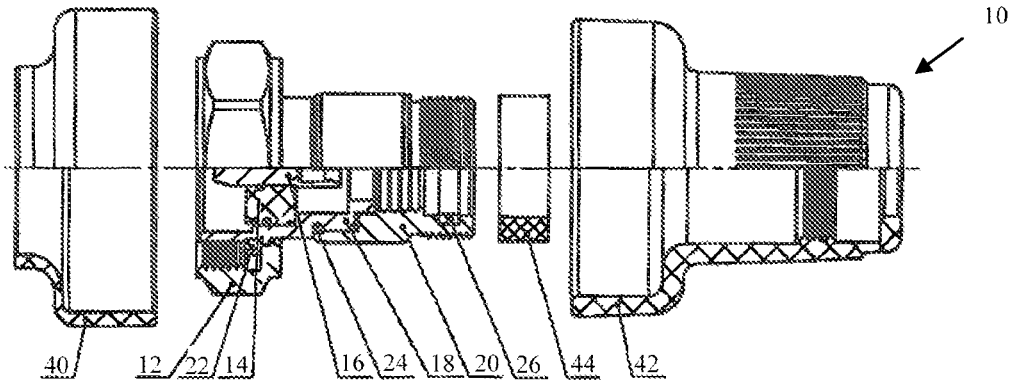
FIG. 4 is a partial exploded and partial cross-sectional view of an integrated compression connector according to an exemplary embodiment of the present invention.
Figure 5:
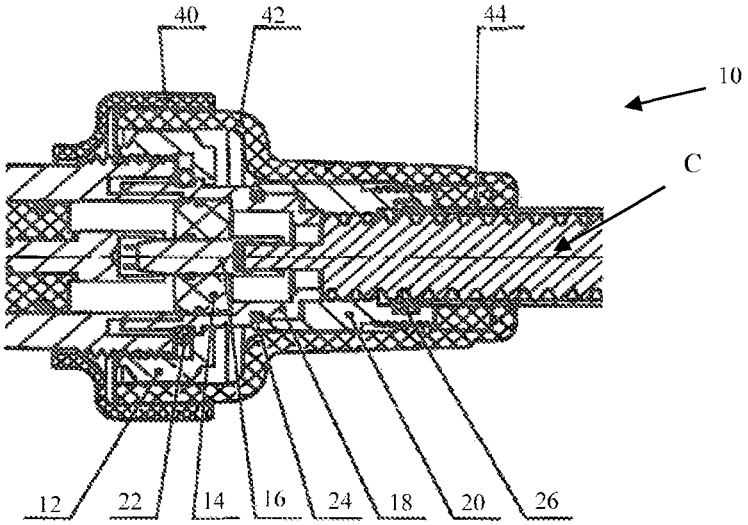
FIG. 5 is a cross-sectional view of the connector illustrated in FIG. 4, showing the connector assembled and a cable terminated to the connector.
Figure 6:
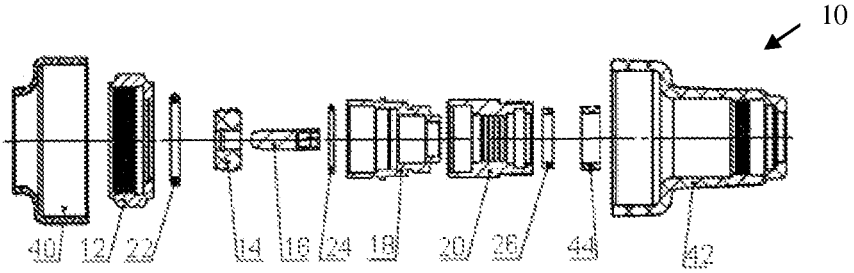
FIG. 6 is an exploded view of the connector illustrated in FIG. 5.

FIGS. 4-6 illustrate another exemplary embodiment of the present invention that adds a front housing 40 and a rear housing 42 to the compression connector 10 for additional water protection. The front housing 40 is preferably formed of rubber and the rear housing 42 is preferably formed of plastic. A sealing ring 44 may be disposed within the end of the rear housing 42 that is used for preventing water from flowing into the connector along the cable C. The front housing 40 and the rear housing 42 are preferably structured in a shape of horn. The front housing 40 and the rear housing 42 are respectively sleeved from the two ends of the connector 10 with the front housing 40 covering the end of the rear housing 42, as seen in FIG. 5. The front housing 40 and the rear housing 42 have openings thereof opposite to each other and are joined in a sealing manner at the threaded sleeve 12 of the connector 10 to provide a water proof structure.

For assembly of the connector in this embodiment, the cable C that is properly wire-stripped and clamped to the connector in the same manner as discussed above, so that the cable C is not easily disengaged from the connector. The housing 18 again moves toward the cable clamp 20 to engage the cable clamp 20 in an interference fit. In addition, when the front housing 40 and the rear housing 42 are joined, the open end of the front housing 40 encloses the open end of the rear housing 42 such that elastic expansion deformation is generated, thus achieving the effect of a sealing connection therebetween. In this embodiment, the rear housing 42 is in threaded engagement with the cable clamp 20 and the sealing ring 44 is disposed within the end of the rear housing 42 so that the sealing ring 44 is pressed tightly when the rear housing 42 is screwed down, thereby forming a waterproof structure.

As in the embodiment above, the elastic nature of the end 32 of the pin 16 allows for clamping of the internal conductor of the cable C. Meanwhile, the main housing 18 of the connector 10 and the cable clamp 20 are integrally structured through the interference fit therebetween such that rapid, stable and reliable installation of the cable C is realized by pressing the outer conductor of the cable C tightly through the cable clamp 20. The connector of this embodiment is also sealed by the front rubber housing 40 and the rear plastic housing 42. Different types of front rubber housings, such as threaded or smooth, etc., may be used according to different interface forms of the equipment.

Figure 7:
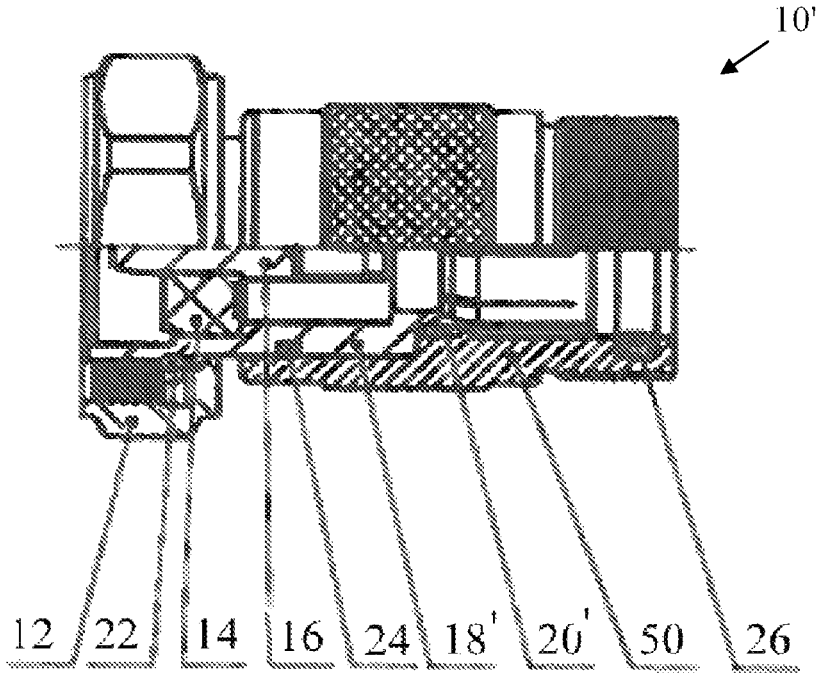
FIG. 7 is a partial cross-sectional view of an integrated compression connector according to an exemplary embodiment of the present invention.
Figure 8:
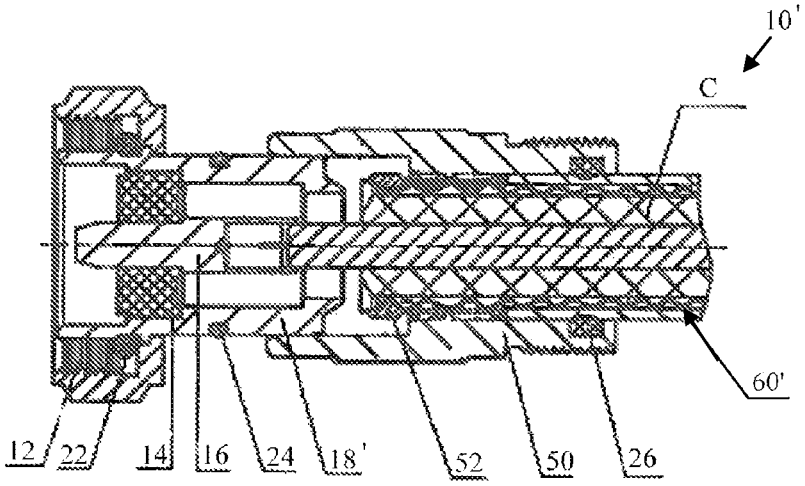
FIG. 8 is a cross-sectional view of the connector illustrated in FIG. 7, showing a cable, such as a feeder cable, terminated to the connector.

FIGS. 7 and 8 illustrate yet another exemplary embodiment of the present invention that adds a secondary housing 50 to the connector 10 and that receives a cable clamp 20' (FIG. 10) that may have a collet structure. In this embodiment, the connector 10' is preferably used to terminate a cable C, such as a feeder cable that has an annular corrugated outer conductor 60'. The secondary housing 50 is preferably made of metal. A lug boss 52 may be arranged on an inner surface of the cable clamp 20' for engaging the cable C, which improves the connection stability of the connector 10'. A main housing 18' (FIG. 11) of the connector is preferably in an interference fit with the secondary housing 50 and is preferably installed coaxially with the pin 16. The interference fit between the main housing 18' and the secondary housing 50 forms an integrated connector structure. The cable clamp 20' is disposed within the secondary housing 50 and is external of the main housing 18'. An O-shaped ring 24 may be arranged between the main housing 18' and the secondary housing 50 to improve the water proof property of the connector. The flat O-shaped ring 26 may be arranged within the secondary housing 50 to prevent water from flowing into the connector 10' along the cable C.

For the assembly of the compression connector 10' in this embodiment, a properly prepared cable C is inserted thru the end of the secondary housing 50 so that the cable passes through the inner bore of the cable clamp 20' and the lug boss 52 therein is embedded in a valley of the outer corrugated conductor 60' of the cable C. The connector 10' is clamped to the cable C by pressing and clamping the clamp 20' directly on the outer corrugated conductor, so that the cable C is not easily disengaged from the connector. In the process of the clamping of cable C, the main housing 18' is moved towards the cable clamp 20' and the secondary housing 50 until the main housing 18' is received in the secondary housing 50 in an interference fit to form the integrated structure. As with the previous embodiment, the elastic nature of the pin 16 combined with interference fit between the main housing 18' and the secondary housing 50 results in an integral structure, allowing for rapid, stable and reliable installation of the cable by pressing the outer conductor 60' of the cable tightly through the cable clamp 20' and the secondary housing 50.

Figure 9:
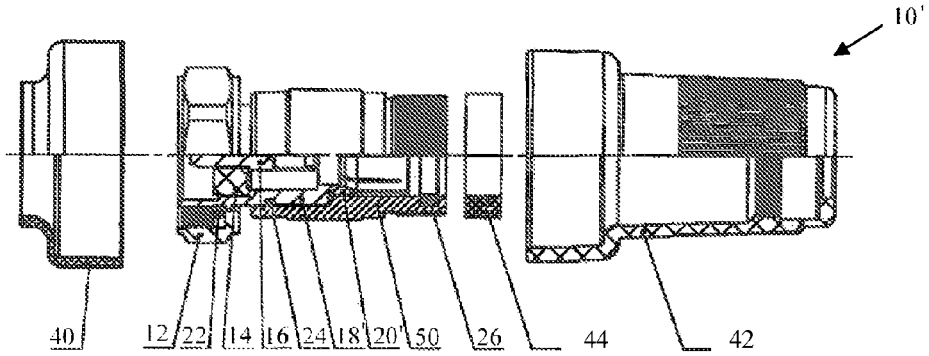
FIG. 9 is a partial exploded and partial cross-sectional view of an integrated compression connector according to an exemplary embodiment of the present invention.
Figure 10:
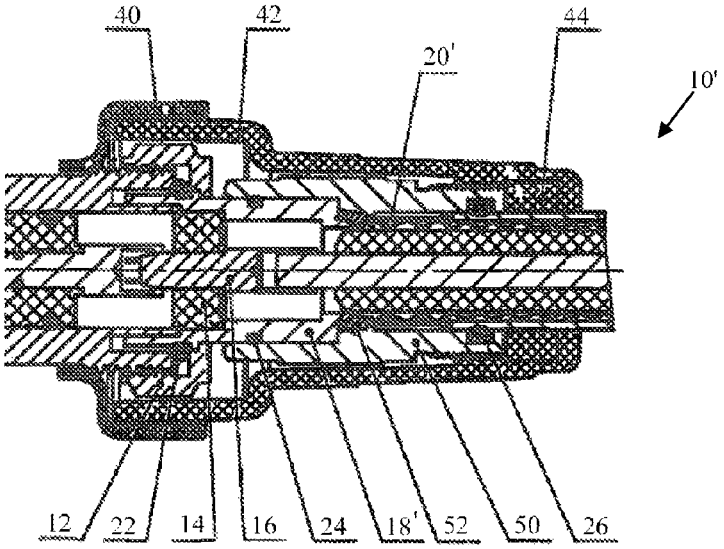
FIG. 10 is a cross-sectional view of the connector illustrated in FIG. 9, showing the connector assembled and a cable terminated to the connector.
Figure 11:
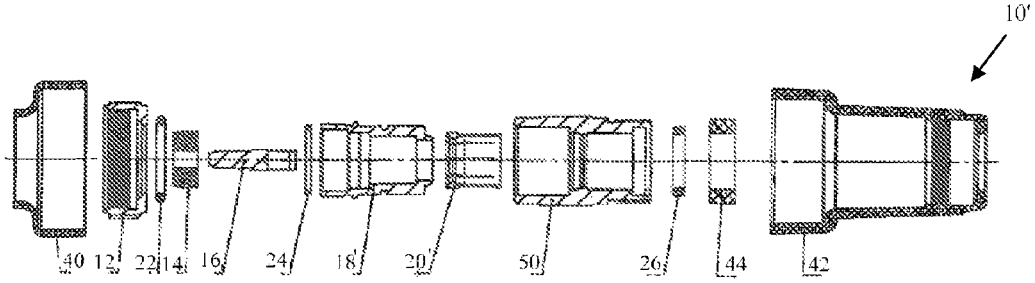
FIG. 11 is an exploded view of the connector illustrated in FIG. 10.

FIGS. 9-11 illustrate still another exemplary embodiment of the present invention that add the front and read housing 40 and 42 to the connector 10' of the embodiment of FIGS. 7 and 8. The sealing ring 44 may be disposed within the end of the rear housing 42 for preventing water from flowing into the connector along cable C. The front housing 40 and the rear housing 42 are sleeved from the two ends of the connector such that the rear housing covers the secondary housing 50 and the front housing 40 covers the open end portion of the rear housing 42, as seen in FIG. 10. The front housing 40 and the rear housing 42 have opposite openings and are joined in a sealing manner at the threaded sleeve 12 of the connector 10.

To assemble the compression connector of this embodiment, the cable C, that is properly wire-stripped, is inserted in via the secondary housing 50 so that the cable C passes through the inner bore of the cable clamp 20' and the lug boss 52 of the cable clamp 20' is embedded in a first valley of the cable C, as described above. In the process of clamping the cable C, the housing 18' is moved towards the cable clamp 20' and the secondary housing 50, to form an interference fit with secondary housing 50. In addition, when the front housing 40 and the rear housing 42 are joined, the open end of the front housing 40 encloses the open end of the rear housing 42 such that an elastic expansion deformation is generated, thus achieving the effect of sealing connection. The rear housing 42 is in threaded connection with the secondary housing 50, so that the sealing ring 44 disposed within the end of the rear housing 42 is pressed tightly while the rear housing 42 is screwed down, thereby forming a waterproof structure.

While particular embodiments have been chosen to illustrate the invention, it will be understood by those skilled in the art that various changes and modifications can be made therein without departing from the scope of the invention as defined in the appended claims.

What is claimed is:

1. An integrated compression connector, comprising:

a main housing having opposing first and second ends, said main housing supporting a pin, said pin being supported by an insulator disposed in said main housing, said pin including an elastic end for engaging a cable conductor;

a threaded sleeve externally coupled to said main housing at said first end thereof;

a secondary housing externally coupled to said main housing at said second end thereof; and a cable clamp received in said secondary housing and externally coupled to said main housing, said cable clamp being configured to clamp to a corrugated outer conductor of a cable, wherein said main housing engages said secondary housing in an interference fit to form an integrated structure.

2. An integrated compression connector according to claim 1, further comprising a sealing ring disposed between said main housing and said secondary housing.

3. An integrated compression connector according to claim 1, further comprising a sealing ring disposed between said secondary housing and the cable.

4. An integrated compression connector according to claim 1, further comprising front and rear housings, said rear housing covering said secondary housing, and said front housing receiving a portion of said rear housing, thereby forming a seal over said threaded sleeve.

5. An integrated compression connector according to claim 4, wherein said front housing is rubber and said rear housing is plastic.

6. An integrated compression connector according to claim 1, wherein said main housing and said secondary housing are metal.

7. An integrated compression connector according to claim 1, wherein said cable clamp is configured to clamp to an annular corrugated outer conductor of the cable.

8. An integrated compression connector according to claim 1, further comprising:

a lug boss arranged on an inner surface of said cable camp for engaging the cable.

* * * * *